US012000213B2

(12) United States Patent
Hammargren

(10) Patent No.: US 12,000,213 B2
(45) Date of Patent: Jun. 4, 2024

(54) DRILL BIT

(71) Applicant: SANDVIK MINING AND CONSTRUCTION TOOLS AB, Sandviken (SE)

(72) Inventor: John Hammargren, Sandviken (SE)

(73) Assignee: Sandvik Mining and Construction Tools AB, Sandviken (SE)

( * ) Notice: Subject to any disclaimer, the term of this patent is extended or adjusted under 35 U.S.C. 154(b) by 174 days.

(21) Appl. No.: 17/624,825

(22) PCT Filed: Jul. 3, 2020

(86) PCT No.: PCT/EP2020/068753
§ 371 (c)(1),
(2) Date: Jan. 4, 2022

(87) PCT Pub. No.: WO2021/004909
PCT Pub. Date: Jan. 14, 2021

(65) Prior Publication Data

US 2022/0268104 A1 Aug. 25, 2022

(30) Foreign Application Priority Data

Jul. 5, 2019 (EP) ..... 19184793

(51) Int. Cl.
*E21B 10/567* (2006.01)

(52) U.S. Cl.
CPC ..... *E21B 10/5673* (2013.01)

(58) Field of Classification Search
CPC ..... E21B 10/38; E21B 10/36; E21B 10/43; E21B 10/60; E21B 10/56; E21B 10/40
See application file for complete search history.

(56) References Cited

U.S. PATENT DOCUMENTS

2014/0291035 A1* 10/2014 Seppala ..... E21B 10/56 175/420.1
2014/0299388 A1* 10/2014 Rindeskar ..... E21B 10/5673 175/430
2017/0081920 A1* 3/2017 Hemph ..... E21B 10/46

FOREIGN PATENT DOCUMENTS

EP 0345096 A1 12/1989
EP 2921639 A1 9/2015
(Continued)

OTHER PUBLICATIONS

"Secoroc Rock Drilling Tools Tophammer Equipment", Atlas COPCO Product Catalogue, p. 20, p. 29. www.atlascopco.com.
(Continued)

*Primary Examiner* — Tara Schimpf
*Assistant Examiner* — Jennifer A Railey
(74) *Attorney, Agent, or Firm* — Corinne R. Gorski

(57) ABSTRACT

A drill bit for percussion drilling includes a drill bit body including a front surface. The front surface includes a first circular area arranged transverse and coaxially to the axis of the drill body, a second area surface surrounding the first area surface, and a third area surface surrounding the second area surface. A number of buttons are arranged in the second and third area surfaces. The button body of each button has a forward end surface. The buttons are arranged in circular recesses extending substantially transverse from the second surface and third area surface into the drill bit body. The recesses have a radius corresponding to the button body radius and a depth corresponding to the length of the button body, such that the button bodies are fitted within the drill bit body with the forward end surface exposed in the second and third area surfaces.

13 Claims, 5 Drawing Sheets

(56) References Cited

FOREIGN PATENT DOCUMENTS

| | | | |
|---|---|---|---|
| SU | 1581837 | C2 | 7/1990 |
| WO | 2004104362 | A1 | 12/2004 |

OTHER PUBLICATIONS

COPROD Drill Strings for SmartROC C50 and SmartROC CL. epiroc.com.
Mincon DTH Tools Product Catalogue, p. 50, p. 55. www.mincon.com.
Mitsubishi. Mitsubishi Materials. "Rock Tools Advanced Manufacturing Methods for Consistently Higher Quality." p. 20, p. 43, p. 76. http://mrt.mitsubishicarbide.com.
Robit DTH Production Drilling Catalogue.

* cited by examiner

DRILL BIT

RELATED APPLICATION DATA

This application is a § 371 National Stage Application of PCT International Application No. PCT/EP2020/068753 filed Jul. 3, 2020 claiming priority to EP 19184793.8 filed Jul. 5, 2019.

FIELD OF THE INVENTION

The present invention generally relates to a drill bit for percussion drilling, and a drill arrangement comprising said drill bit.

TECHNICAL BACKGROUND

Within the constructional work sector and the mining industry percussion drilling, i.e. top hammer drilling, is an established method for drilling vertical bore holes with a drill bit arranged in the forward end of an elongated drill string or cable. During drilling, a hammering impact from a hydraulically driven piston is acting on the drill string to exert the required force to break the rock and generate the bore hole.

There are a number of different sizes and types of drill bits adapted to generate the desired bore hole in different types of rocks. However, there is always a need to improve the drilling performance which could be done by improvements of the drill bits.

SUMMARY

It would be advantageous to achieve a drill bit that fulfills at least some of the needs mentioned above. To better address one or more of these concerns a drill bit as defined in the independent claim is provided. Preferred embodiments of the drill bit are defined in the dependent claims.

The drill bit for percussion drilling according to the invention comprises:

- a drill bit body intended to extend along an axis A and comprising a front surface, said front surface comprises a first circular area surface arranged transverse and coaxially to axis A, a second area surface surrounding said first area surface, said second area surface is extending in an angle $\alpha$ in relation to a plane transverse to axis A, and a third area surface surrounding said second area surface, said second area surface is extending in an angle $\beta$ in relation to a plane transverse to axis A such that the front surface will have a substantially convex shape; and
- a number (n) of buttons arranged in said second and third area surface, said buttons have a button body extending along an axis B and a length L along axis B, said button body has a circular cross-sectional shape transverse to axis B, a rear end surface and a forward end surface,
- wherein the angle $\alpha$ is within the range of 5 to 15°, the angle $\beta$ is within the range of 30 to 45° and the buttons are arranged in circular recesses extending substantially transverse from the second and third area surfaces into the drill bit body, said recesses have a radius corresponding to the button body radius and a depth corresponding to the length L of the button body such that the button bodies are fitted within the drill bit body.

The characteristic design of the front surface of the drill bit according to the invention is very advantageous since the angles of the second and third area surface will increase the distance between the inner ends of the recesses in which the buttons are fitted. The increased distance improves the strength of the drill bit and prevents the buttons being accidentally removed from the drill bit during drilling due to breakage in the drill bit body.

Alternatively, the drill bit according to the invention could be used to increase the number and/or radius of the buttons arranged in the second and third area surfaces without reducing the strength of the drill bit which will have a positive impact on the drilling performance and extend the life time of the drill bit.

In one embodiment of the drill bit according to the invention, the first circular area surface has a first radius, the second area surface extends from the periphery of the first area surface to a second radius and the third area surface extends from the periphery of the second area surface to a third radius, said first radius is within the range of 25 to 65% of the third radius and said second radius is within the range of 60 to 80% of the third radius. A drill bit front surface with these proportions will make it possible to fit the desired number of buttons in the second and third areas and provide the desired increase in distance between adjacent recesses.

In one embodiment of the drill bit according to the invention, the third radius is within the range of 30 to 65 mm.

In one embodiment of the drill bit according to the invention, the buttons arranged in the third area surface have a larger button body radius than the button body radius of the buttons arranged in the second area surface. The larger buttons in the third area surface is favorable since the buttons located at the larger distance from axis A will rotate at higher speed which will increase the wear. The effect of the larger radius is that the buttons in the second and third layer will be worn out about simultaneously, resulting in extended or optimized life time of the drill bit.

In one embodiment of the drill bit according to the invention, the drill bit body comprises a cylindrical section intended to be arranged within the recess in the drill bit body and the length L of the drill bit body is measured along axis B from the end surface to a plane transverse to axis B arranged in the opposite end of the cylindrical section of the drill bit body.

In one embodiment of the drill bit according to the invention, the forward end surface of the buttons has a half-spherical or convex shape such that the forward end surface extends from the second area surface and the third area surface of the drill bit body.

In one embodiment of the drill bit according to the invention, the number of buttons arranged in the third area surface is within the interval of 8 to 12 and preferably within the range of 9 to 11. This drill bit configuration provides excellent drilling characteristics and results in the wear on the buttons in the first and second areas being about the same.

In one embodiment of the drill bit according to the invention, the buttons in the third area surface have a button body radius within the range of 5 to 9 mm, and preferably within the range of 6 to 8 mm. This drill bit configuration provides excellent drilling characteristics and results in the wear on the buttons in the first and second area surfaces being about the same.

In one embodiment of the drill bit according to the invention, the ratio between the third radius and the number of buttons arranged in the third area surface*button body radius of the buttons in the third area surface is within the range of 0.6 and 0.8, i.e. the ratio=R3/(n3*Rb3) is within the range 0.6 to 0.8. This drill bit configuration provides excellent drilling characteristics.

In one embodiment of the drill bit according to the invention, the number of buttons arranged in the second area surface is within the interval of 5 to 10.

In one embodiment of the drill bit according to the invention, the ratio between the button body length and the button body radius of the buttons in the third area surface, i.e. ratio=L3/Rb3, and the ratio between the button body length and the button body radius of the buttons in the second area surface, i.e. ratio=L2/Rb2, both are within the range of 1.8 to 2.2.

In one embodiment of the drill bit according to the invention, the circular recesses in the third area surface and the circular recesses in the second area surface are arranged such that the distance between the inner end of adjacent circular recesses is at least 2.5 mm measure from outside diameter at two corresponding points one each on different neighboring recesses being closest to each other. The characteristic design of the drill bit front surface increases the distance between adjacent recesses in the second and third area which makes it possible to always have a distance of at least 2.5 mm between adjacent holes.

In one embodiment of the drill bit according to the invention, at least two flushing media outlets are arranged in the front surface, and a groove extending in substantially radial direction outwards from axis A from the respective outlet is formed in the front surface. By having the flushing media lead via the flushing media outlets particles and gravel removed during drilling are flushed from the drilling area. This reduces the wear on the drill bit and enables good contact between the drill bit and the rock and therefore optimizes drilling performance.

In one embodiment of the drill bit according to the invention, the flushing media outlets are arranged in the first and/or second area surface.

In one embodiment of the drill bit according to the invention, the buttons in the third area surface are arranged at substantially the same distance from axis A and at a substantially constant distance from each other around the third area surface. The symmetric positioning of the buttons in third area surface ensures reliable drilling for a long period of time.

In one embodiment of the drill bit according to the invention, the drill bit body comprises an peripheral side surface extending from the periphery of the front surface towards a rear end of the drill bit, and a number of grooves are formed in the peripheral side surface and the front surface, said grooves are arranged between adjacent buttons in the third area surface and extend from the third area surface substantially parallel to axis A towards the rear end of the drill bit. The grooves facilitate the transport of free particles and gravel from the drilling area.

BRIEF DESCRIPTION OF THE DRAWINGS

The invention will be better understood through the following illustrative and non-limiting detailed description of preferred embodiments, with reference to the appended drawings.

All figures are schematic, not necessarily to scale, and generally only illustrating parts which are necessary to elucidate the invention, wherein other parts may be omitted or merely suggested.

DETAILED DESCRIPTION OF EMBODIMENTS

Figure 1:
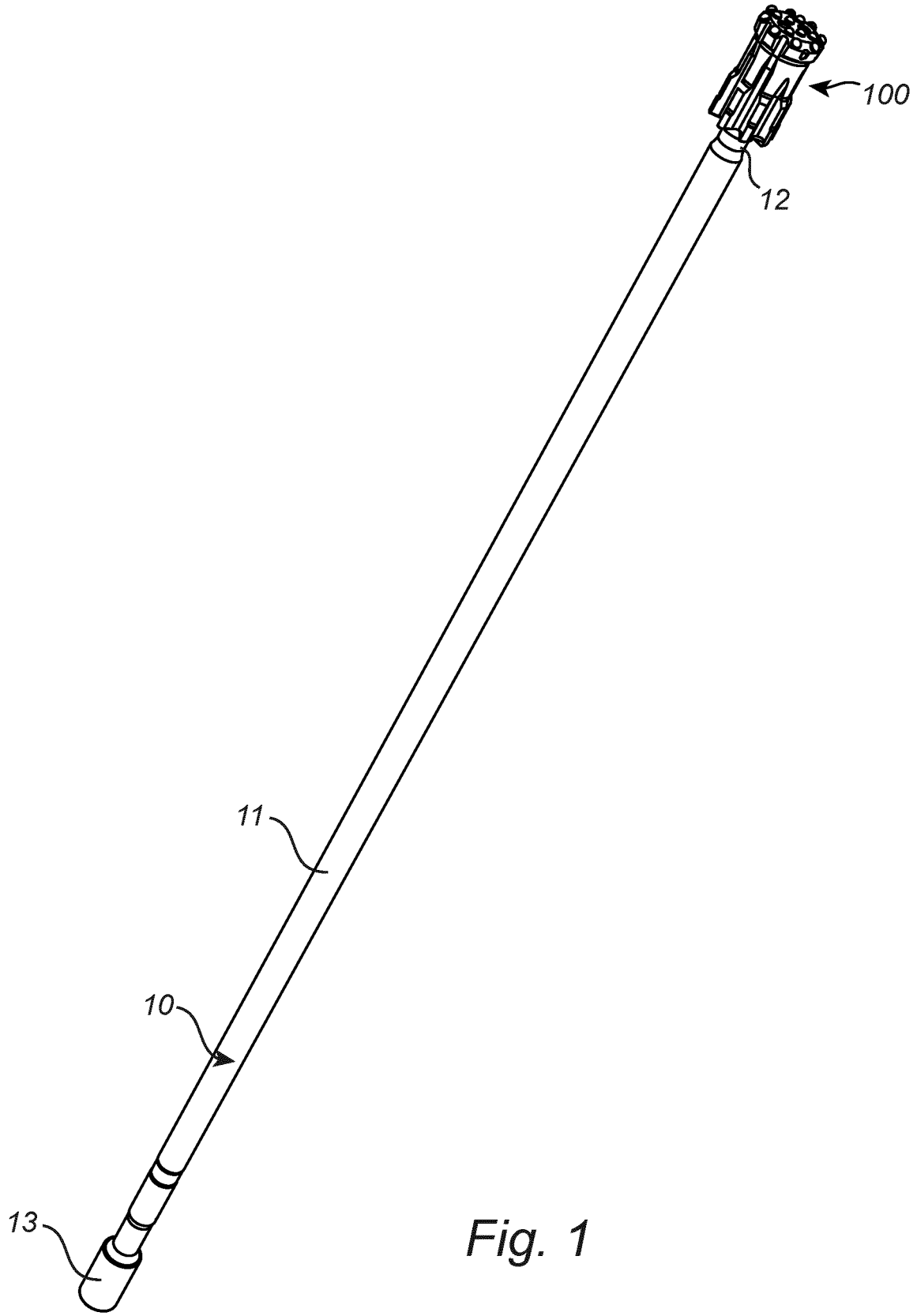
FIG. 1 is a perspective view of a drill arrangement comprising a drill string rod and a drill bit.
Figure 2:
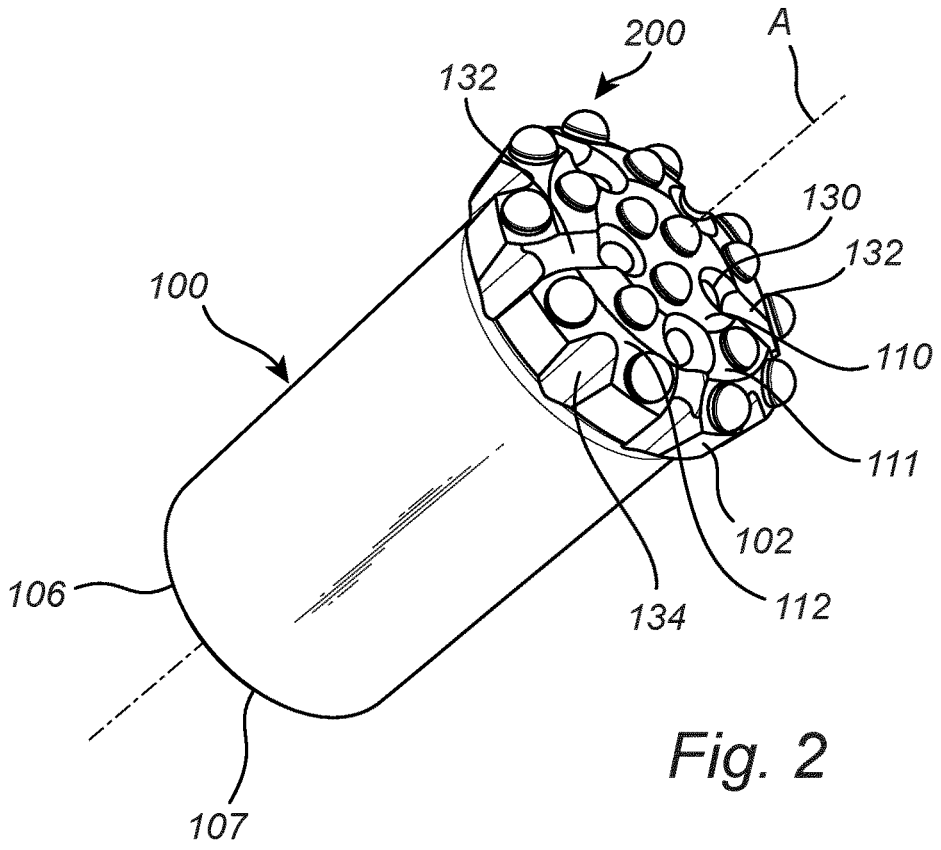
FIG. 2 illustrates a perspective view of a drill bit according to the invention.
Figure 4:
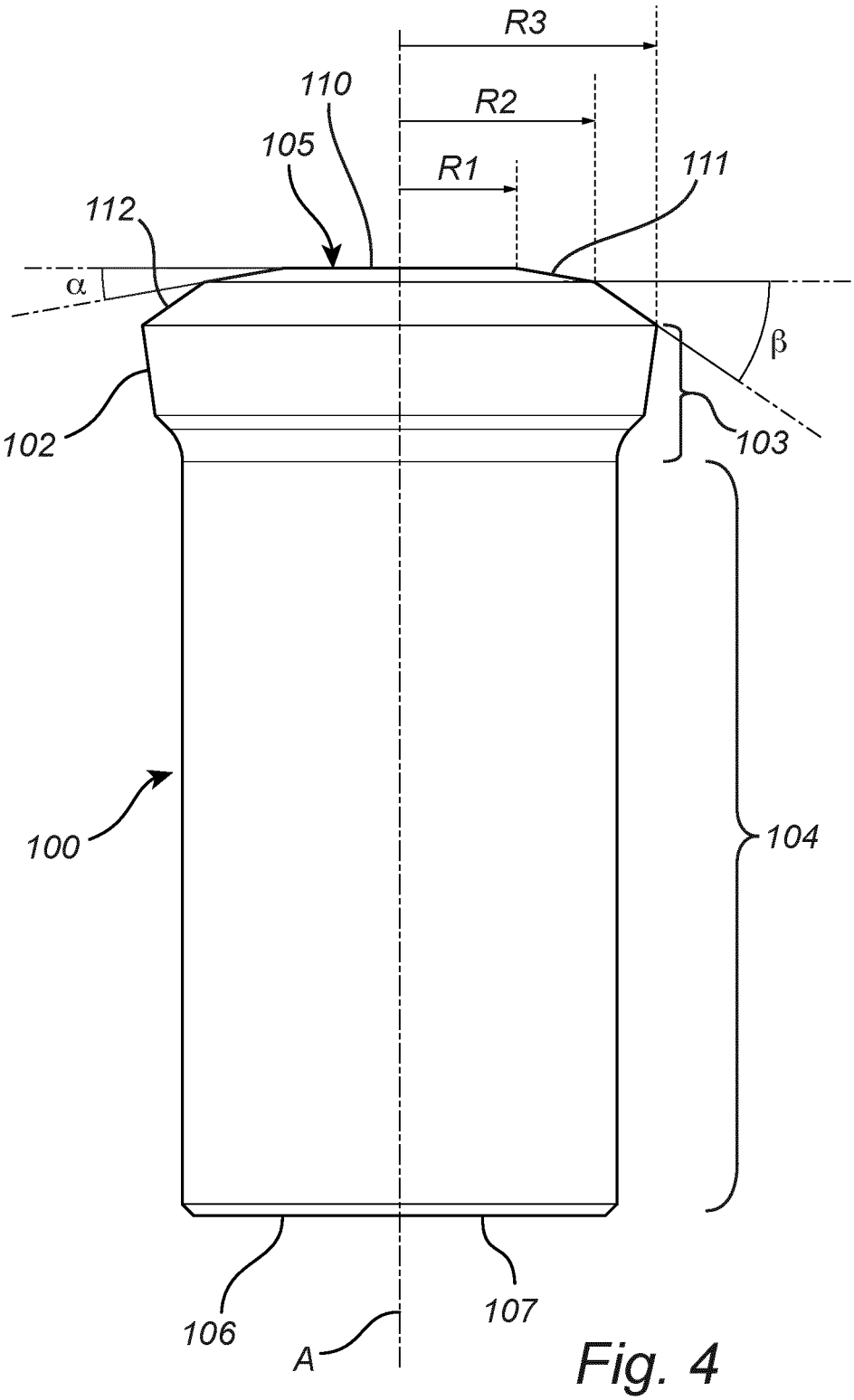
FIG. 4 illustrates a schematic side view of the drill bit to more clearly illustrate the characteristic design of the front surface.
Figure 5:
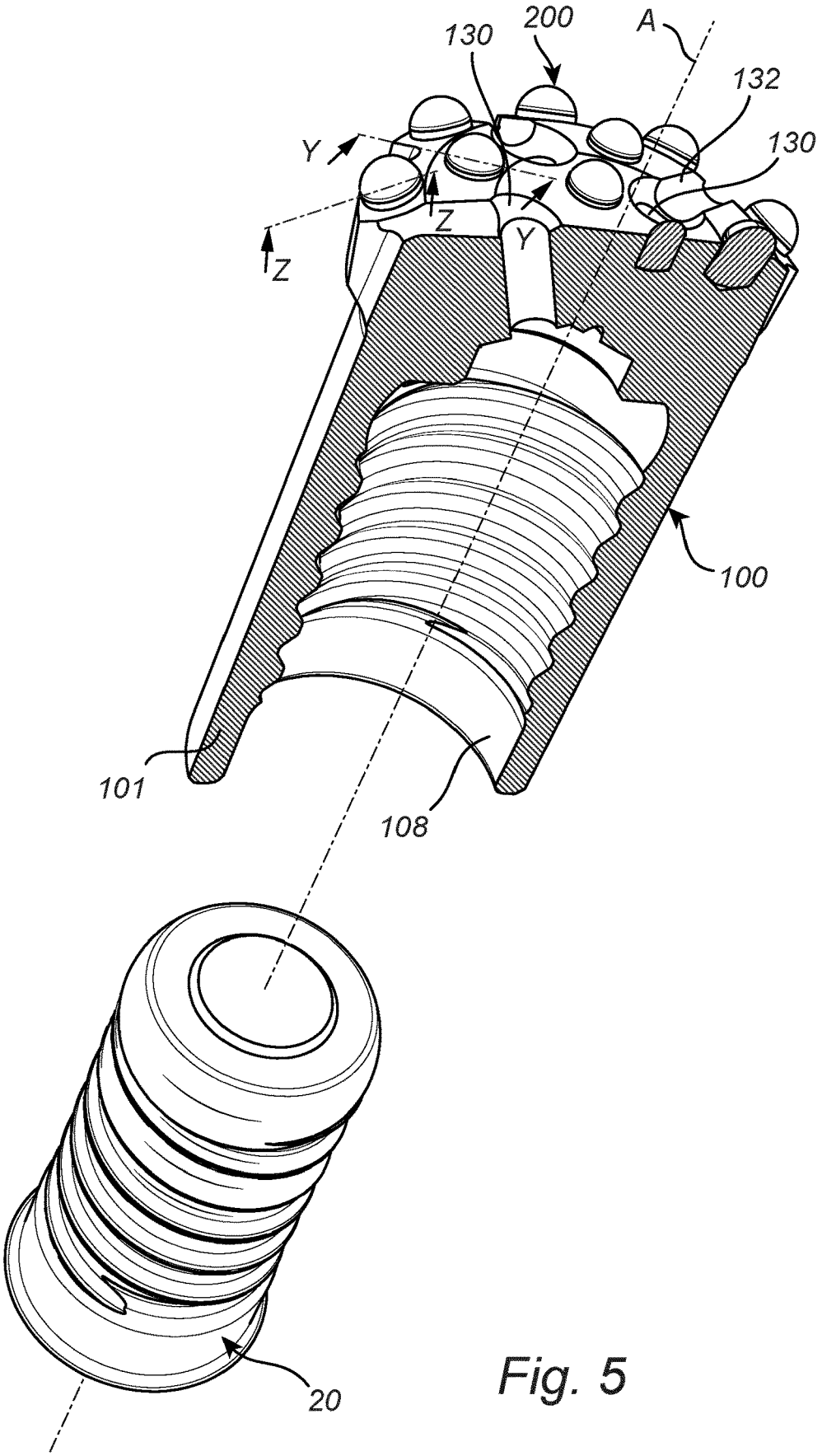
FIG. 5 illustrates a cross-sectional view of the drill bit along axis A, and the forward end of the drill string.
Figure 6:
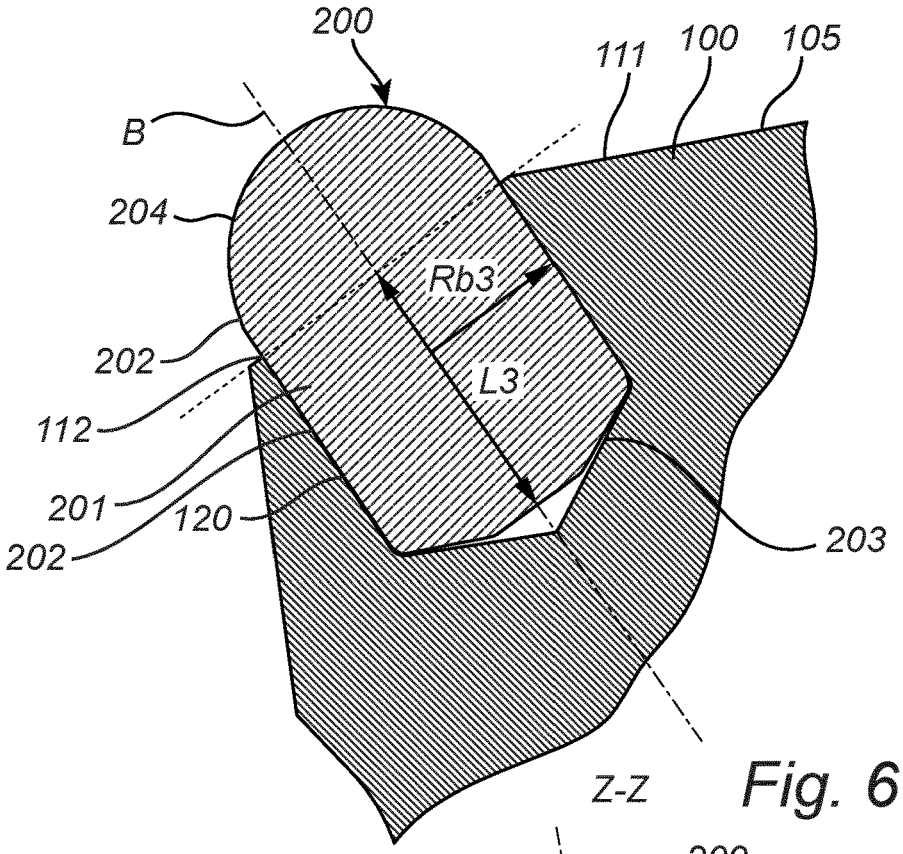
FIG. 6 illustrates a cross-sectional view through the drill bit along line Z-Z in FIG. 5.
Figure 7:
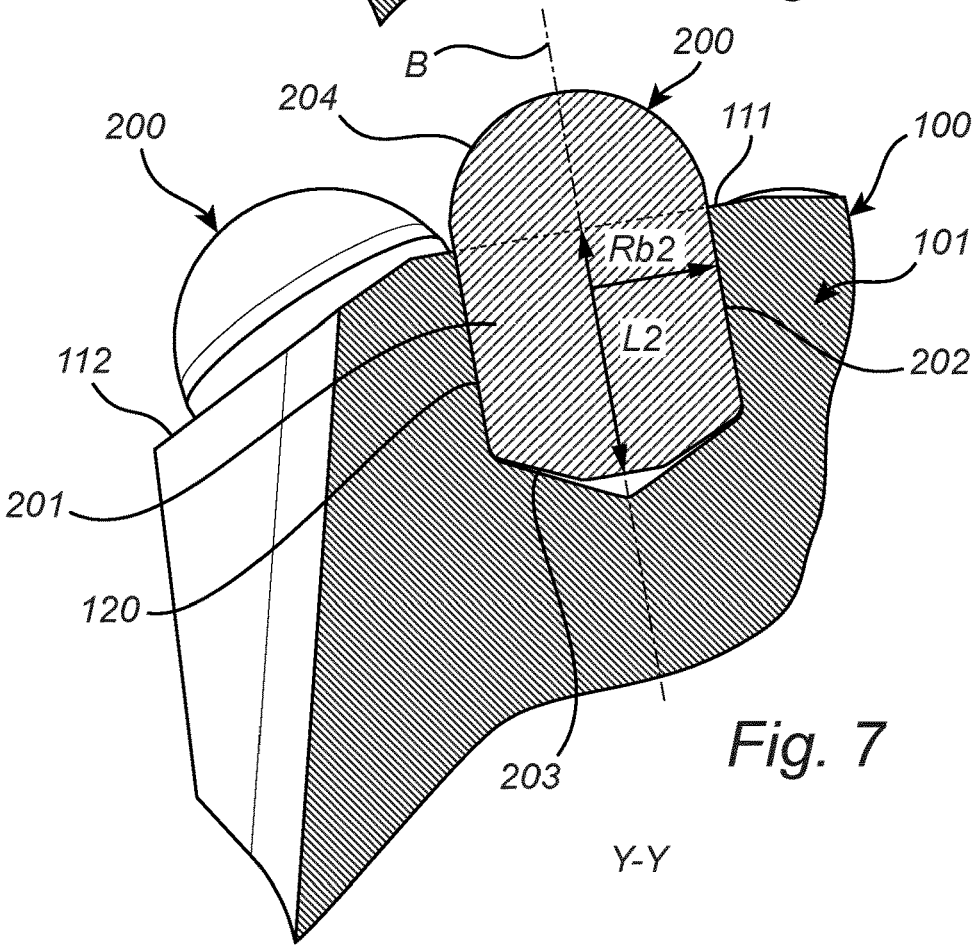
FIG. 7 illustrates a cross-sectional view through the drill bit along line Y-Y in FIG. 5.

In FIG. 1 a perspective view of a drill arrangement for percussion drilling is illustrated. The drill arrangement comprises a drill string rod 10 and a drill bit 100. The drill string rod 10 comprises an elongated intermediate section 11 extending along a longitudinal axis A (as seen in FIGS. 2, 4 and 5). In the illustrated embodiment, a male coupling 12 is arranged in one end of the intermediate section 11 and a female coupling 13 in the opposite end. The male and female couplings are intended to make it possible to connect the drill bit 100 in the forward end of the drill string rod 10, and the female coupling in the rear end of the drill string rod is intended for connecting further drill string rods to form a drill string with the desired length by connecting the male coupling of an identical drill string rod to the female coupling of the adjacent drill string rod. During drilling, further drill string rods 10 are connected to extend the length of drill string 100 as the depth of the bore hole increases. In the illustrated embodiment male/female couplings are illustrated but other coupling arrangements could be used to adapt the arrangement for different needs.

During drilling, the rear end of the drill string 10 is connected to a hydraulically driven piston, not illustrated, arranged to provide the desired axial force and rotation of the drill string, the guide adapter and the drill bit to conduct the percussion drilling. The design of the drill string rod, the guide adapter and the drill bit are adapted to specific needs depending on the different types of rock materials and the desired bore hole diameter to be drilled. Larger bore hole diameters require larger dimensions of the different components to ensure that they are able to withstand the loads during drilling. The drill string rod could be embodied in different ways and for example the intermediate section 10 could have a circular, rectangular, pentagonal or hexagonal cross-sectional shape as long as the required strength is ensured. The intermediate section comprises a passage extending in the center of the intermediate section through the drill string rod to direct flushing media through the drill string to the drill bit arranged in the forward end of the drill string to remove particles and gravel from the bore hole during drilling. The flushing media is for example air, water or a mixture of air and water.

Figure 3:
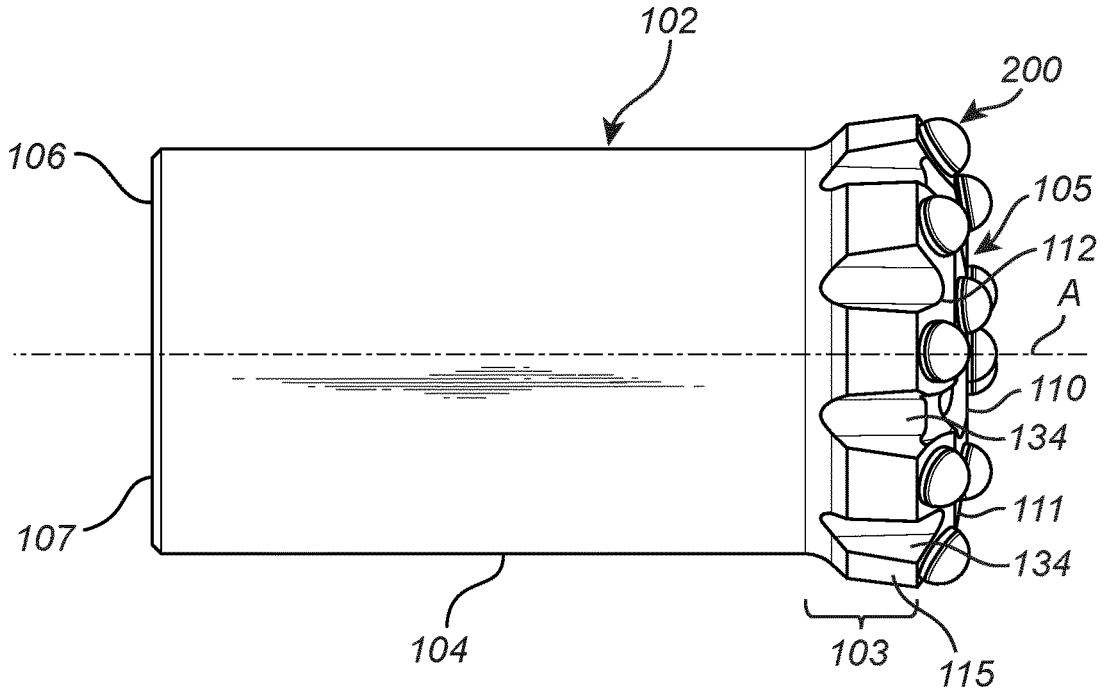
FIG. 3 illustrates a side view of the drill bit according to the invention.

FIGS. 2 and 3 illustrates a perspective view and a side view of the drill bit 100 according to the invention. The drill bit comprises a drill bit body 101 intended to extend along axis A. The drill bit body has a substantially cylindrical shape with a circular cross-section transverse to axis A.

In the forward end 102 of the drill bit 100, a forward body section 103 with a slightly larger radius is arranged to support a front surface 105, and in the rear end 106 the drill bit body is ended by a substantially flat rear surface 107. In the rear surface 107 a female coupling 108 is arranged extending coaxially to axis A in the drill bit body 101. The female coupling 108 is not visible in FIG. 2 or 3 but illustrated in FIG. 5.

The front surface 105 has a very characteristic design and comprises a first circular area surface 110 arranged transverse and coaxially to axis A. The first circular area has a first radius R1. The first area surface 110 is surrounded by a second area surface 111 extending in an angle α in relation to a plane transverse to axis A from the periphery of the first area to a second radius R2. Furthermore, the front surface comprises a third area surface 112 surrounding said second area. The third area surface 112 is extending from the periphery of the second area surface 111 in an angle β in relation to a plane transverse to axis A to a third radius R3. The first 110, second 111 and third 112 area surface are co-axial to each other such that the front surface 105 will have a substantially convex shape.

In order to achieve the desired characteristics of the drill bit, the angle α is within the range of 5 to 15° and could be a specific angle there between such as 6, 8, 10, 12 or 14°. And the angle β is within the range of 30 to 45° and could be a specific angle there between such as 32, 34, 36, 38, 40, 42 or 44°.

Furthermore, the first radius R1 is within the range of 25 to 65% of the third radius R3 and could be a specific amount there between such as 28, 32, 36, 40, 44, 48, 52, 56, 60 or 63%. And said second radius R2 is within the range of 60 to 80% of the third radius R3 and could be a specific amount there between such as 62, 64, 66, 68, 70, 72, 74, 76 or 78%. This to make it possible to secure a number of buttons in the second and third area in a reliable way.

The drill bit 100 according to the invention could be embodied in different sizes but the third radius R3 defines the maximum radius of the drill bit body and is in preferred embodiments of the drill bit 100 within the range of 30 to 65 mm and could be a specific range there between such as 32, 36, 40, 44, 48, 52, 56, 60 or 63 mm.

In the drill bit front surface 105, a number n of buttons 200 are arranged. The buttons 200 are intended to form the bore hole in the rock and are made of a material that is resistant to wear to ensure the desired drilling action for a long period of time.

The buttons 200 could be embodied in different ways and examples of buttons are illustrated in different views in FIGS. 2 to 7. All embodiments comprise a button body 201 intended to extend along an axis B. The button body 201 (as referred to in FIGS. 6 and 7) has a circular cross-sectional shape transverse to axis B with substantially constant radius Rb along the button body, i.e. the cylindrical section 202. The button body 201 has a rear end surface 203 and a forward end surface 204. The rear end surface 203 is either substantially flat, or convex as the button illustrated in FIGS. 5 to 7, and the forward end surface 204 has a half-spherical, or convex, shape. The half-spherical or convex shape ensures that the forward end surface 204 extends from the front surface 105 of the drill bit body 101 such that the front end surface 204 will be in contact with the bottom of the bore hole instead of the front surface 105 of the drill bit body. The inner ends of the recesses corresponds to the rear end surface 203 of the buttons arranged in the recesses.

The buttons 200 arranged in the third area surface 112 have a front end surface shape and dimension selected such that the front end surface of the button has at least the same radial extension as the third radius R3, and preferably exceeds the radial extension of the third radius R3 to ensure that the button 200 will form the bore hole and the periphery of the drill bit body 101 is prevented from contact with the side walls of the bore hole.

The length L of the button body is measured along axis B and depends on the size of the drill bit the button is intended to be used in combination with. The length of the button body is measured from the rear end surface 203 to a plane transverse to axis B arranged in the opposite end of the cylindrical section of the button body and is intended to be arranged substantially in line with the first, second or third area of the front surface of the drill bit. The lengths L2 and L3 for the buttons arranged in the second 111 and third area surfaces 112 respectively illustrate this length in FIGS. 6 and 7.

The cylindrical section of the buttons is fitted in corresponding recesses 120 in the front surface 105 of the drill bit 100. The recesses 120 extend in a substantially transverse direction from their respective position in the front surface 105 of the drill bit, i.e. in transverse direction from the first 110, second 111 or third 112 area surfaces into the drill bit body. The recesses 120 have a radius corresponding to the button body radius and a depth corresponding to the length L of the button body such that the circular section of the button bodies is fitted within the drill bit body and are reliably secured in the drill bit body.

The center of the recesses 120 is preferably arranged close to the center of the third or second area surfaces, i.e. the recesses 120 and buttons 220 in respective area surfaces are arranged at substantially the same distance from axis A, such that enough of the drill bit body material remains around the recess to ensure sufficient strength for the button to be secured in the drill bit body.

The buttons 200, and consequently also the recesses 120 formed in the drill bit body, are arranged at a substantially constant distance from each other around the third 112 and second 111 area surfaces to ensure the same strength and characteristics of all button fittings.

Since the general idea of the drill bit according to the invention is to provide drill bits that are able to withstand the high loads that are generated during drilling, the circular recesses in the second area surface are arranged substantially in the center between the circular recesses in the third area surface 112 to ensure that the maximum distance between adjacent recesses is achieved. In the drill bit according to the invention, the distance between the inner end of adjacent circular recesses is at least 2.5 mm.

Preferably the buttons 200 arranged in the third area surface 112 have a larger button body radius Rb3 than the button body radius Rb2 of the buttons arranged in the second area to increase the life time of the buttons in the third area that are rotating at higher speed during drilling. In preferred embodiments of the drill bit, the buttons in the third area have a button body radius Rb3 within the range of 5 to 9 mm, and preferably within the range of 6 to 8 mm, and could also be 7 mm.

The number n of buttons in the front surface of the drill bit depends on the size of the drill bit. In preferred embodiments of the drill bit the number of buttons arranged in the third area n3 is within the interval of 8 to 12 and preferably 9, 10 or 11, and the number of buttons arranged in the second area n2 is within the interval of 5 to 10 and preferably 6, 7 8 or 9.

As stated above, the drill bit 100 according to the invention could be embodied in many different ways for all preferred embodiments of the drill bit, the ratio between the third radius R3 and the number of buttons arranged in the third area (n3)*(button body radius of the buttons in the third area (Rb3)) is within the range of 0.6 and 0.8, i.e. the ratio=R3/(n3*Rb3) is within the range 0.6 to 0.8, preferably 0.65, 0.70 or 0.75.

Furthermore, as stated above, the buttons in the third area surface 112 has a larger radius than the buttons in the second area but the ratio between the button body length L3 and the button body radius Rb3 of the buttons in the third area, i.e. ratio=L3/Rb3, and the ratio between the button body length L2 and the button body radius Rb2 of the buttons in the second area, i.e. ratio=L2/Rb2, both are within the range of 1.8 to 2.2, preferably 1.9, 2.0 or 2.1.

The drill bits illustrated in the figures furthermore comprises some buttons 200 arranged in the first area surface. The buttons in the first area surface 110 preferably have the same dimensions as the buttons arranged in the second area surface 111 since they will move at a lower speed during drilling as a consequence of their positions close to axis A. The buttons arranged in the first area surface 110 have the same design as the buttons in the second area surface 111 and the third area surface 112 and are fitted in corresponding recesses in the first area extending substantially perpendicularly from the first area into the drill bit body. The number of buttons in the first area is adapted to the size of the drill bit but is preferably within the range of number of 2 to 5. The buttons in the first area surface are positioned at selected positions in the first area such that the entire area of the bore hole arranged in front of the first area will be covered when the drill bit rotates. This means that the buttons could be arranged asymmetrically on the first area.

The drill bit furthermore comprises at least two flushing media outlets 130 arranged in the front surface 105. The flushing media is provided via the drill string 10 to the drill bit 100 in order to flush residues and gravel from the bore hole and maintain the desired drilling performance during drilling. The illustrated flushing media outlets 130 are arranged in the first area 110 and/or second area surface 111, and a recess 132 extending in substantially radial direction outwards from axis A from the respective outlet 130 is formed in the front surface 105 to direct the flushing media and the flushed material away from the drill bit front surface 105.

The drill bit body 101 furthermore comprises a peripheral side surface 115 extending from the periphery of the third area surface 112 of the front surface 105 and a number of grooves 134 are formed in the peripheral side surface 115 and the front surface 105. The grooves 134 are arranged between adjacent buttons 200 in the third area surface 112 and extend from the third area substantially parallel to axis A towards the rear end of the drill bit to facilitate the transport of flushing material together with residues and particles from the drilling area of the bore hole.

While the invention has been illustrated and described in detail in the drawings and foregoing description, such illustration and description are to be considered illustrative or exemplary and not restrictive; the invention is not limited to the disclosed embodiments. The skilled person understands that many modifications, variations and alterations are conceivable within the scope as defined in the appended claims.

Additionally, variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage. Any reference signs in the claims should not be construed as limiting the scope of the claims.

The invention claimed is:

1. A drillbit for percussion drilling, the drill bit comprising:

a drill bit body arranged to extend along an axis and having a front surface, the front surface including a first circular area surface arranged transverse and coaxially to the axis, a second area surface surrounding the first area, the second area surface extending at an angle in relation to a plane transverse to the axis, and a third area surface surrounding the second area surface, the third area surface is extending in an angle in relation to a plane transverse to the axis such that the front surface has a substantially convex shape, wherein the first circular area surface has a first radius (R1), the second area surface extends from a periphery of the first area surface to a second radius (R2) and the third area surface extends from a periphery of the second area surface to a third radius (R3), the first radius (R1) being within the range of 25 to 65% of the third radius (R3) and the second radius (R2) being within the range of 60 to 80% of the third radius (R3), wherein the third radius (R3) is within the range of 30 to 65 mm; and a number (n) of buttons arranged in the second area surface and third area surface, the buttons each having a button body extending along an axis and having a length along a respective button body axis, each button body having a circular cross-sectional shape transverse to the button body axis, a rear end surface and a forward end surface, wherein the number of buttons arranged in the third area is within the range of 9 to 11, wherein the second area surface angle is within the range of 5 to 15°, the third area surface angle is within the range of 30 to 45° and the buttons are arranged in circular recesses extending substantially transverse from the second area surface and third area surface into the drill bit body, wherein the recesses have a radius corresponding to the button body radius (Rb) and a depth corresponding to the length L of the button body such that the button bodies are fitted within the drill bit body with the forward end surface exposed in the second area surface and third area surface.

2. The drill bit according to claim 1, wherein the buttons arranged in the third area surface have a larger button body radius (Rb3) than the button body radius (Rb2) of the buttons arranged in the second area surface.

3. The drill bit according to claim 2, wherein the circular recesses in the third area and the circular recesses in the second area are arranged such that the distance between the inner end of adjacent circular recesses is at least 2.5 mm.

4. The drill bit according to claim 1, wherein the button body includes a cylindrical section arranged within the recess in the drill bit body and the length L of the button body is measured along the button body axis from an end surface to a plane transverse to the button body axis arranged in an opposite end of the cylindrical section of the drill bit body.

5. The drill bit according to claim 1, wherein a forward end surface of the buttons has a half-spherical or convex shape such that the forward end surface extends from the second area surface and the third area surface of the drill bit body.

6. The drill bit according to claim 1, wherein the buttons in the third area surface has a button body radius (Rb3) within the range of 5 to 9 mm.

7. The drill bit according to claim 6, wherein the ratio between the third radius (R3) and the number of buttons arranged in the third area (n3)*(button body radius of the buttons in the third area (Rb3)), ratio=R3/(n3*Rb3) is within the range 0.6 to 0.8.

8. The drill bit according to claim 6, wherein the ratio between the button body length (L3) and the button body radius (Rb3) of the buttons in the third area, ratio=L3/Rb3, and the ratio between the button body length (L2) and the button body radius (Rb2) of the buttons in the second area, ratio=L2/Rb2, both are within the range of 1.8 to 2.2.

9. The drill bit according to claim 8, wherein the flushing media outlets are arranged in the first area and/or the second area surface.

10. The drill bit according to claim 1, wherein the number of buttons arranged in a second area (n2) is within the interval of 5 to 10.

11. The drill bit according to claim 1, wherein at least two flushing media outlets are arranged in the front surface, and a recess extending in a substantially radial direction outwards from the axis from the respective outlet is formed in the front surface.

12. The drill bit according to claim 1, wherein the buttons in the third area surface are arranged at a substantially same distance from the axis and at a substantially constant distance from each other around the third area surface.

13. The drill bit according to claim 1, wherein the drill bit body includes a peripheral side surface extending from the periphery of the front surface towards a rear end of the drill bit, and a plurality of grooves formed in the peripheral side surface and the front surface, plurality of grooves being arranged between adjacent buttons in the third area surface and extending from the third area surface substantially parallel to the axis towards the rear end of the drill bit.

* * * * *